US005329647A

United States Patent [19]

Condon

[11] Patent Number: 5,329,647

[45] Date of Patent: Jul. 19, 1994

[54] FLUSH VALVE FOR LOW WATER VOLUME TOILET

[75] Inventor: Duane R. Condon, Ramona, Calif.

[73] Assignee: Rectorseal Corporation, Houston, Tex.

[21] Appl. No.: 157,942

[22] Filed: Nov. 24, 1993

[51] Int. Cl.[5] ..... E03D 1/34

[52] U.S. Cl. ..... 4/378; 4/391

[58] Field of Search ..... 4/378, 379, 380–383, 4/387–390, 391, 415

[56] References Cited

U.S. PATENT DOCUMENTS

| | | | |
|---|---|---|---|
| 1,307,391 | 6/1919 | Bush | 8/378 |
| 1,319,785 | 10/1919 | Miller | 4/387 |
| 2,361,694 | 10/1944 | Langdon . | |
| 3,282,288 | 11/1966 | Sheppard | 4/378 |
| 3,705,428 | 12/1972 | Braswell | 4/388 |
| 4,106,136 | 8/1978 | Lippincott, Sr. | 4/368 |
| 4,115,881 | 9/1978 | Stone | 4/326 |
| 4,142,262 | 3/1979 | Hamilton | 4/354 |
| 4,183,108 | 1/1980 | Hamilton | 4/354 |
| 4,858,252 | 8/1989 | Johnson | 4/378 |
| 5,218,725 | 6/1993 | Lipman | 4/415 |

FOREIGN PATENT DOCUMENTS

| | | | |
|---|---|---|---|
| 101229 | 3/1965 | Denmark | 4/363 |

*Primary Examiner*—Henry J. Recla

*Assistant Examiner*—Gregory Vidovich

*Attorney, Agent, or Firm*—Baker, Maxham, Jester & Meador

[57] ABSTRACT

A flush valve for a conventional toilet which replaces the conventional flapper valve assembly and seat and operates in conjunction with the standard ballcock valve. A hollow annular drain stopper seat is connected to the upper end of a male threaded cylindrical shank secured in the drain outlet opening of the tank that communicates with the bowl. A stopper fits in a central passage of the drain stopper seat and may be lifted so that water from the tank drains into the bowl through the central passage. At the same time, high pressure water is injected downwardly and tangentially into the central passage through a plurality of circumferentially spaced orifices in the interior cylindrical wall of the drain stopper seat. Water is supplied under pressure from the ballcock valve through a filler hose to an upper pressure chamber in the drain stopper seat that communicates with the orifices. When the stopper descends to seal the central passage in the drain stopper seat, the orifices are located so that the water therefrom refills the tank. The lower end of an overflow tube communicates with the central passage in the shank so that water supplied from the standard refill hose of the ballcock valve can refill the bowl with standing water to provide a trap seal.

10 Claims, 5 Drawing Sheets

FLUSH VALVE FOR LOW WATER VOLUME TOILET

BACKGROUND OF THE INVENTION

The present invention relates to plumbing installations, and more particularly, to a new design for the mechanisms contained within the water tank of a household toilet which improve the flushing efficiency thereof.

For many decades, conventional household toilets have used a generally rectangular porcelain tank mounted immediately above a porcelain bowl from which five to seven gallons of water are rapidly drained in order to flush the waste into the sewer system. One very common design uses a flapper valve made of an elastomeric material that normally covers the drain outlet of the tank. When the flush handle on the outside of the tank is manually depressed the flapper valve is lifted and the head of water in the tank drains through the drain outlet into the bowl. The flapper valve is designed so that it initially floats as it is lifted away from the drain outlet in the bottom of the tank. This allows sufficient flushing water to flow into the bowl even if the user immediately releases the flush handle. There is typically a ballcock valve mounted on the left side of the tank which is connected to a pressurized water line in the house. When the tank drains, a float ball connected to the ballcock valve descends. This turns the ballcock valve ON and it begins to refill the tank with water at a rate much slower than the rate at which water flows through the drain outlet. When the tank is nearly empty, the flapper valve closes. The tank continues to refill as the float ball connected to the ballcock rises. At the same time water from the ballcock valve enters an overflow tube and refills the bowl to the normal standing water level. This provides a trap seal. Once the float ball reaches a predetermined height indicating that the tank is full, the ballcock valve completely turns OFF.

The foregoing conventional household toilet is wasteful and inefficient since a relatively large quantity of water is used to accomplish each flush. This is because the limited elevation of the tank provides only a modest water pressure head. The pressure head is obtained from the potential energy stored in the tank. As the body of water flows through the drain outlet of the tank, it starts the siphoning action and flushes the standing water in the bowl and its waste contents into the sewer line.

Simply increasing the volume of the tank but leaving it directly mounted adjacent the top edge of the bowl in order to achieve a greater pressure head wastes even more water. Another approach which is used in Europe is to mount the tank on the wall near the ceiling and to connect the drain outlet of the tank to the bowl with a pipe as a way of increasing the pressure head. This European approach is generally considered too unattractive and unsafe for use in the United States. Toilets have also been commercialized with pressurized tanks to improve flushing efficiency. However, these toilets have been too costly to manufacture and assemble and they lack the reliability needed for thousands of flushes.

Fresh water is becoming an increasingly valuable natural resource. Many geographic regions of the United States, such as Southern California, have experienced prolonged periods of drought. Arid parts of the country often take water from remote locations whose environments suffer as a result. For example, Los Angeles diverts large amounts of water from Mono Lake which has shrunk significantly since the 1930's. Furthermore, the more water that is flushed down toilets, the more volume of sewage there is that must be treated. Sewage delivery systems and treatment plants are expensive to construct and maintain. Treatment plants require large amounts of land and have offensive odors. Residents near any proposed sewage treatment site will often object vehemently.

According to a Dec. 19, 1980 report by the U.S. Environmental Protection Agency (EPA), approximately 40% of the water used in a home is flushed down the toilet. The typical toilet in the U.S. uses between 3.5 and 7 gallons of water per flush. Effective Jan. 1, 1994 a new Federal law will require the installation of toilets in all new construction that use 1.6 gallons or less of water per flush. There is a critical need to ensure effective flushing in such toilets for sanitation reasons. Also, unless the flushing action in such low water volume toilets can be made efficient, users will flush them twice during each visit to the bathroom to ensure a complete flush, thereby negating the intended water savings.

There is also a critical need to design an apparatus to retrofit existing 3.5, 5 and 7 gallon toilets to lessen the amount of water used during each flush while maintaining an effective flush. Various approaches have been heretofore employed in regions subject to water rationing to reduce water consumption by conventional toilets. These have included lowering the tank level or introducing a brick or dam to decrease the water volume released during each flush. However these approaches have generally been unsatisfactory because the consequent reduction in water flow into the bowl often results in incomplete flushing. Users then flush twice, compounding the waste of water.

SUMMARY OF THE INVENTION

It is therefore the primary object of the present invention to provide an improved toilet with a flush valve which reduces water consumption while effectively removing waste from the toilet bowl.

It is another object of the present invention to provide an improved flush valve which can be readily retrofitted into conventional toilets in order to reduce water consumption while still effectively removing waste from the toilet bowl.

It is another object of the present invention to provide an improved flush valve for a low water volume toilet which is inexpensive to manufacture and which has a very low incidence of failure.

It is another object of the present invention to provide and improved flush valve which may be rapidly installed in both conventional toilets and new low water volume toilets to reduce water consumption and improve flushing efficiency.

By way of summary, my invention is adapted for use in a conventional toilet having a bowl and a tank connected to the bowl. The tank holds a quantity of water for draining into the bowl through a drain outlet. A standard ballcock valve is mounted in the tank and connected to a pressurized water line. A float is connected through an arm to the ballcock valve for turning it ON and OFF in response to a water level in the tank. A manually operated flush actuator such as a handle or a pushbutton is mounted on the outside of the tank. The ballcock valve further has a filler tube for refilling the tank and a refill hose for refilling the bowl.

My improved flush valve includes a drain stopper seat mounted over the drain outlet. The stopper seat has a generally cylindrical central passage through which water from the tank can drain into the bowl. The stopper seat includes a hollow pressure chamber having a plurality of circumferentially spaced orifices that extend downwardly through an interior wall thereof. These orifices communicate with the central passage. A filler hose is coupled between the filler tube of the ballcock valve and a fitting of the drain stopper seat.

My improved flush valve further includes a stopper sized for sealing the central passage through the drain stopper seat when in a lowered position so that water ejected from the orifices will fill the tank. When the stopper is in a raised position, the relatively high pressure water ejected from the orifices will join water draining from the tank through the central passage to increase the velocity of water flowing into the bowl to thereby improve the efficiency of the flush.

The flush handle is linked to the stopper with a lever arm and chain so that manual depression of the handle will raise the stopper out of its seat. An overflow tube has a lower end coupled to the drain outlet of the tank. The refill hose of the ballcock valve is coupled to the upper end of the overflow tube.

My improved flush valve further includes a cylindrical shank connected to a lower end of the drain stopper seat and extending through the drain outlet of the tank. The shank has a central passage communicating with the central passage of the drain stopper seat. The lower end of the overflow tube is connected to the shank so that water can flow from the overflow tube, through at least one aperture in a wall of the shank and into the bowl when the stopper is in its lowered position. The drain stopper seat has a refill chamber for communicating between the lower end of the overflow tube and at least one aperture in the wall of the shank.

The drain stopper seat has an upper curved wall for streamlining an outer configuration thereof to lower the flow resistance into the central passage. The central passage through the drain stopper seat has a larger diameter than the central passage through the cylindrical shank which further serves to increase the velocity of the water draining from the tank into the bowl.

BRIEF DESCRIPTION OF THE DRAWINGS

FIG. 6 is drawn close to actual scale.

DETAILED DESCRIPTION OF THE PREFERRED EMBODIMENT

Figure 1:
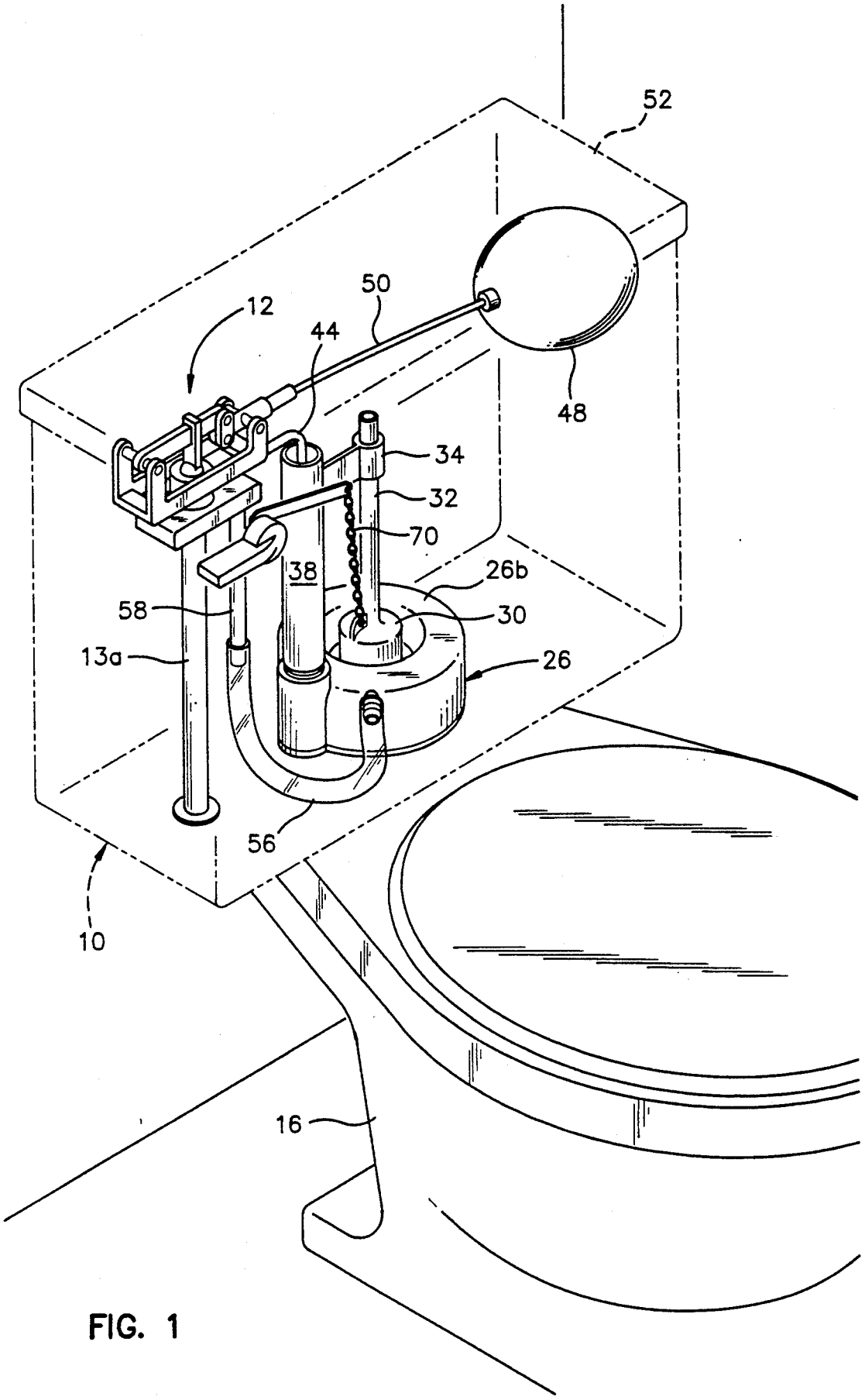
FIG. 1 is a generally perspective fragmentary view of a toilet with its tank illustrated in phantom lines and with a preferred embodiment of the flush valve of the present invention installed and connected to a conventional ballcock valve.

The subject invention replaces the standard flapper valve assembly of a conventional toilet having a porcelain tank 10 (FIG. 1) and a standard ballcock valve 12. The ballcock valve 12 is conventionally mounted on the upper end of a water inlet pipe 13*a* (FIG. 2) whose lower end is coupled to a pressurized household water wire 13*b*. My flush valve assembly mounts in the standard two inch drain hole 14 (FIG. 6) in the center of the bottom wall 15 of the tank 10 through which the water in the tank drains into a conventional porcelain toilet bowl 16 (FIG. 1) to accomplish the flushing action.

In accordance with the preferred embodiment of my invention a hollow cylindrical male threaded shank 18 (FIG. 5) mounts through the drain hole 14 of the tank 10 and is secured to the bottom wall 15 of the tank 10 by a nut 22 screwed over the shank 18. An elastomeric seal ring 24 fits snugly over the lower end of the shank 18 and covers the nut 22.

Figure 2:
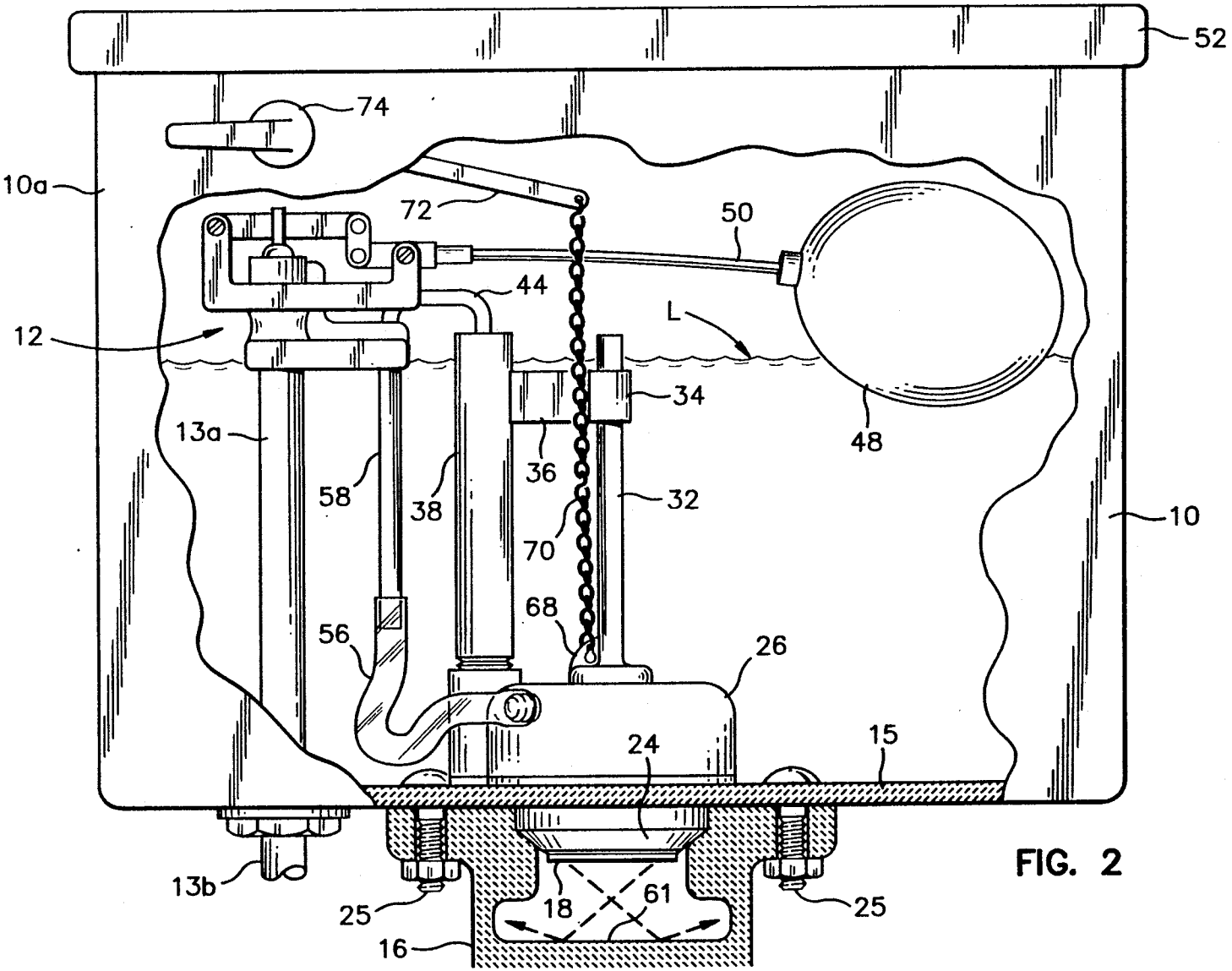
FIG. 2 is an enlarged side elevation of the tank of the toilet of FIG. 1 with a portion broken away to illustrate further details of the preferred embodiment. A rear portion of the bowl is shown vertically sectioned beneath the drain outlet of the tank.
Figure 3:
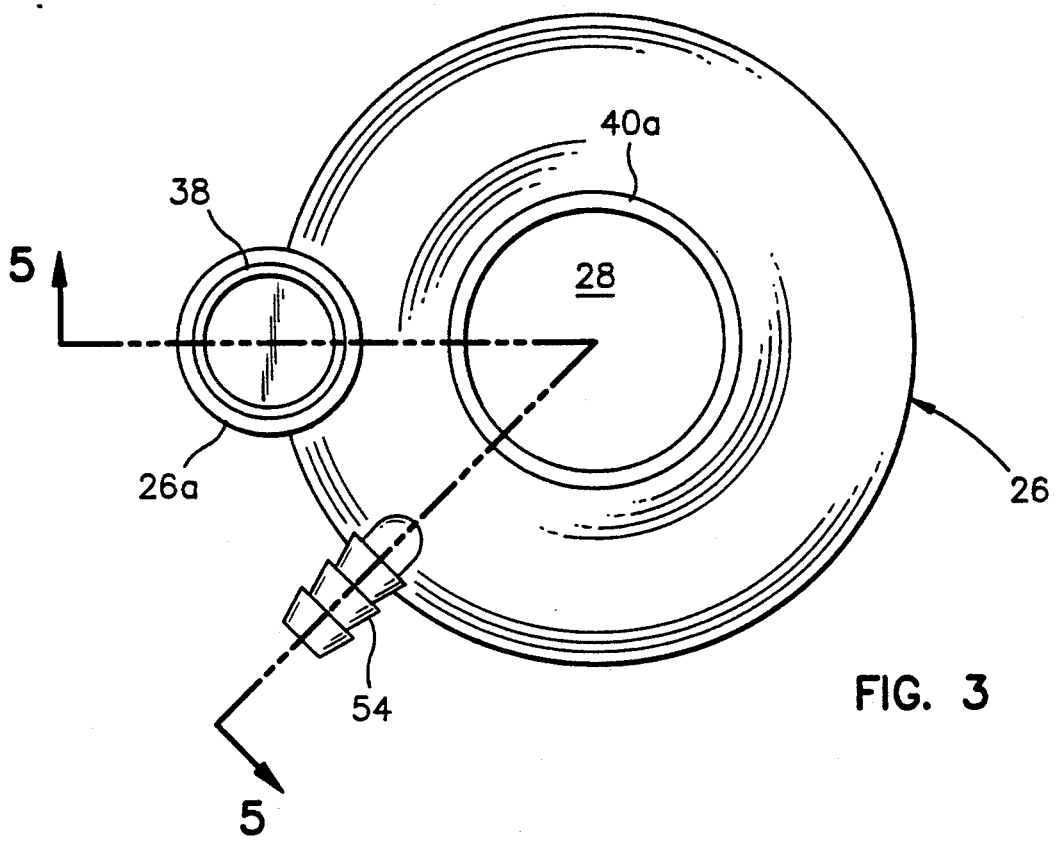
FIG. 3 is an enlarged top plan view of the drain stopper seat and overflow tube of the preferred embodiment.

As is conventional, the tank 10 sits on top of the rear edge of the toilet bowl 16 as shown in FIG. 2 and is secured thereto with bolts 25 that extend through the bottom wall 15 of the tank 10. The lower end of the cylindrical shank 18 extends through a hole that exists in the standard bowl 16.

Figure 5:
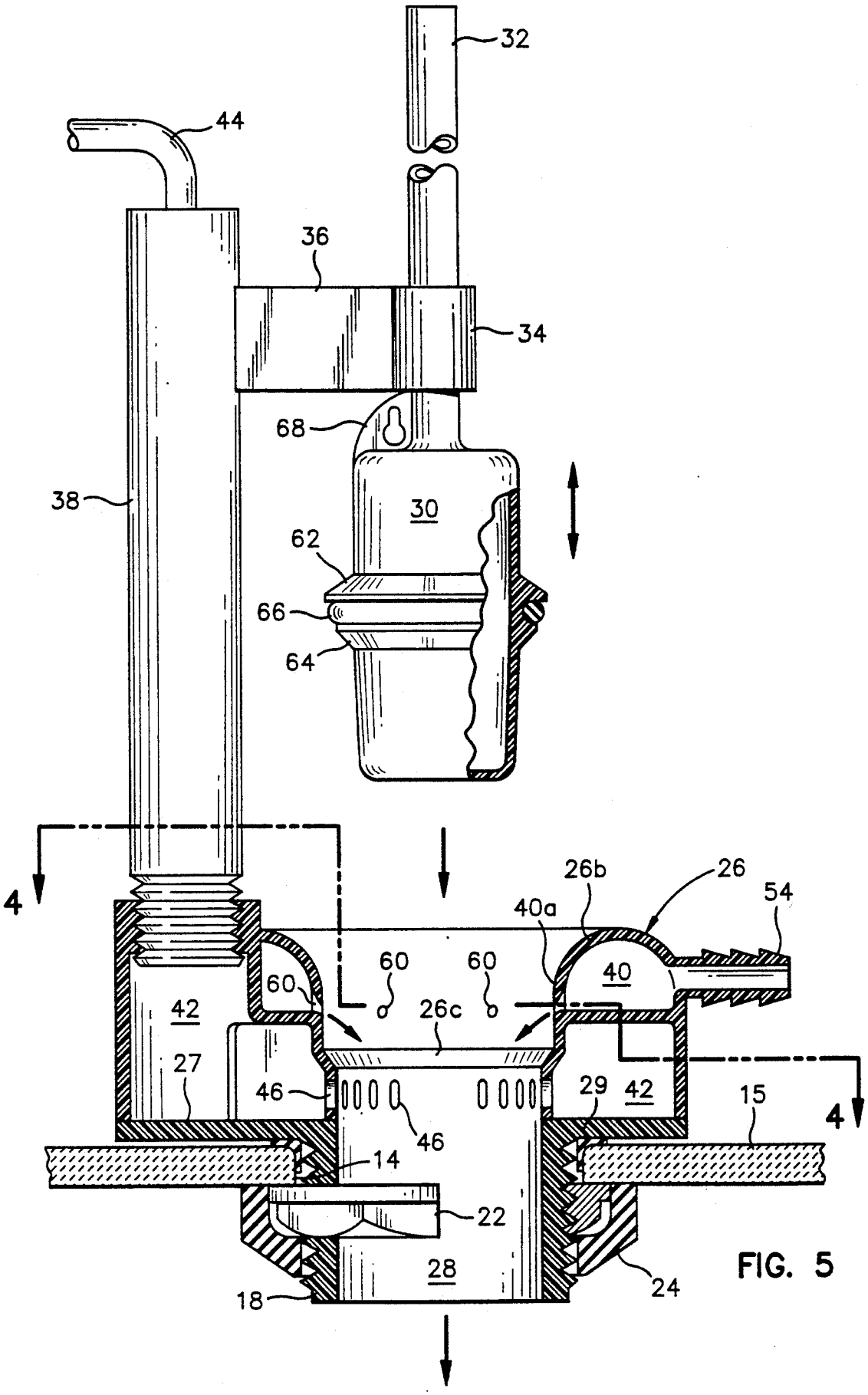
FIG. 5 is a part vertical sectional, part side elevational view of the drain stopper seat, overflow tube and drain stopper of the preferred embodiment. The vertical section portion of this figure has been taken along line 5—5 of FIG. 3 and expanded to one-hundred and eighty degrees to illustrate details of the drain stopper seat not otherwise visible. The drain stopper is shown in its raised open position in FIG. 5.

Connected to the upper end of the cylindrical shank 18 is a hollow drain stopper seat 26 having a horizontal disk-shaped base 27 (FIG. 5). Water from within the tank 10 can flow through a common central vertical passage 28 of the drain stopper seat 26 and the cylindrical shank 18. An elastomeric gasket 29 having an L-shaped cross-section surrounds the upper end of the cylindrical threaded shank 18. This gasket is squeezed between the base 27 of the drain stopper seat and the bottom wall 15 of the tank 10 when the nut 22 is tightened. The gasket provides a water tight seat that prevents water from leaking out of the tank 10 past the nut 22.

Figure 6:
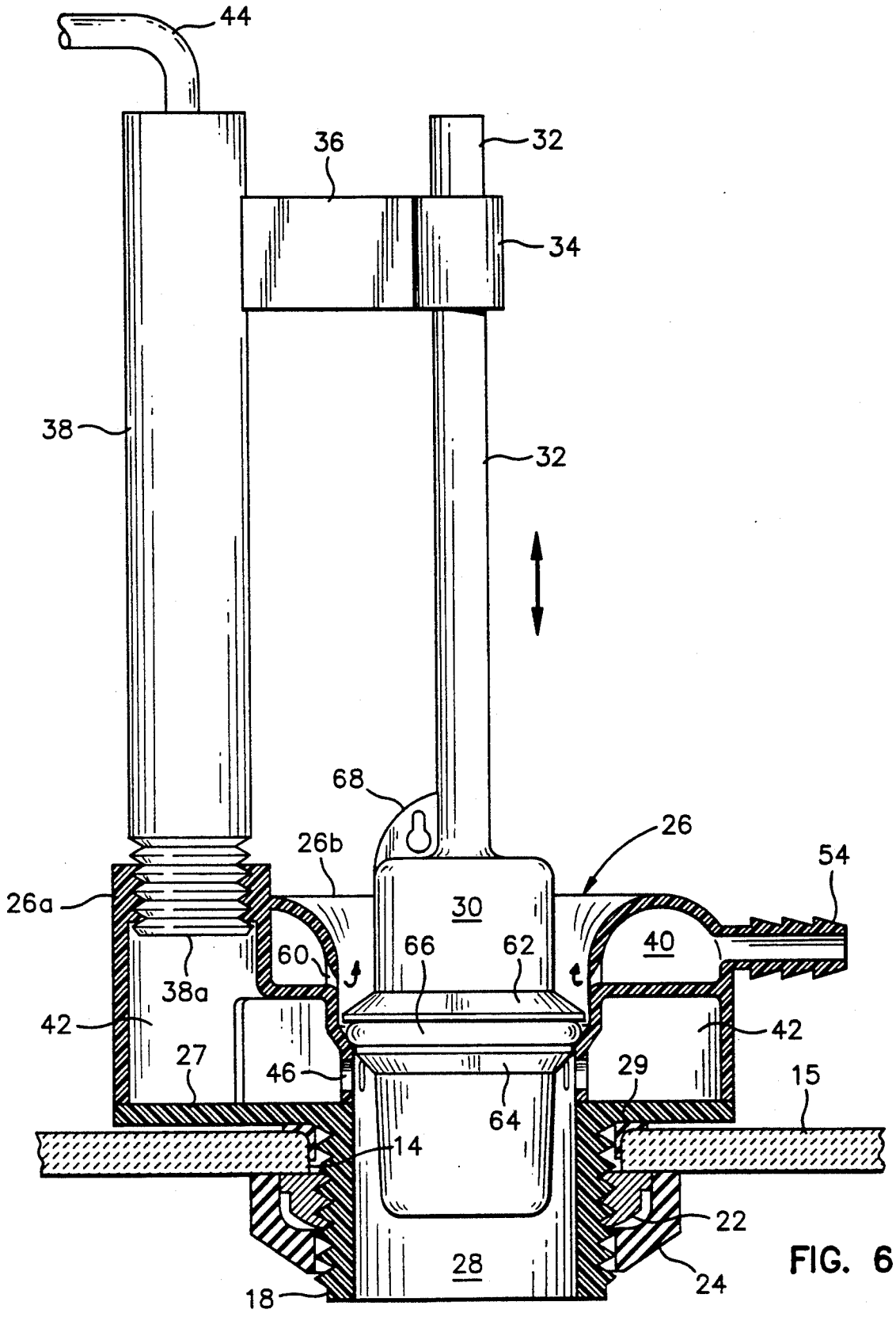
FIG. 6 is a part vertical sectional, part side elevational view of the drain stopper seat, overflow tube and drain stopper of the preferred embodiment. The vertical section part of this figure has been taken diametrically through the stopper seat in a vertical plane through FIG. 2. The drain stopper is shown in its lowered closed position in FIG. 6.

The central passage 28 can be sealed by a vertically reciprocable hollow stopper 30 (FIG. 6). The stopper 30 is connected to the lower end of a guide rod 32 which slides vertically within a cylindrical guide piece 34. The guide piece 34 is connected to the outer end of a horizontal arm 36. The inner end of the arm 36 is connected to the upper end of a hollow vertical overflow tube 38. It is important that the arm 36 extend diametrically across the drain stopper seat 26. This aligns the guide piece 34 over the center of the passage 28. This ensures free upward and downward movement of the stopper 30 relative to the seat 26. Binding between the stopper 30 and the interior side wall of the seat 26 is thus avoided.

Referring still to FIG. 6, the drain stopper seat 26 has a generally hollow construction that defines an upper annular pressure chamber 40 and a lower annular refill chamber 42. The lower end of the vertical overflow tube 38 has male threads 38*a* which screw into a female threaded portion 26*a* of the stopper valve seat 26. The interior of the overflow tube 38 thus communicates with the lower refill chamber 42. The end of the conventional refill hose 44 (FIG. 1) of the ballcock valve 12 is inserted into the hollow upper end of the overflow tube 38. Water from the refill hose 44 flows through the overflow tube 38, through the refill chamber 42 and through circumferentially spaced apertures 46 in the drain stopper seat 26. The apertures 46 communicate with the intermediate portion of the central passage 28 that extends through the drain stopper seat 26 and cylindrical shank 18. If for some reason the ballcock valve 12 does not turn OFF when the conventional float 48 (FIG. 1) connected thereto by arm 50 reaches a predetermined maximum height, excess water spills through the overflow tube 38 and into the toilet bowl 16. This prevents the tank from spilling out underneath the tank lid 52 onto the floor. The refill hose 44 refills the bowl 16 with standing water upon completion of the flushing action.

Figure 4:
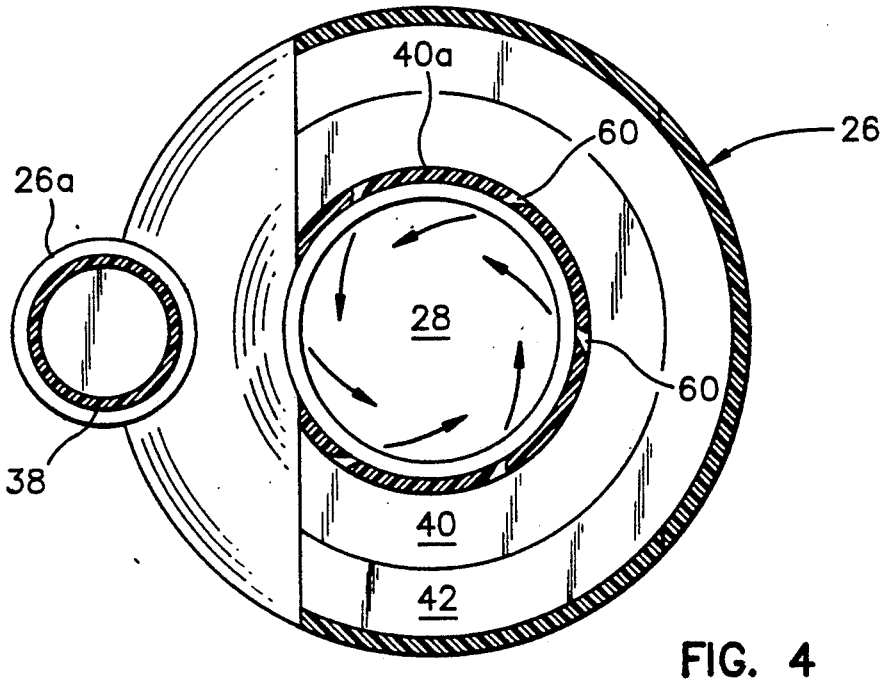
FIG. 4 is an enlarged top plan view of the drain stopper seat and overflow tube of the preferred embodiment horizontally sectioned in part along line 4—4 of FIG. 5. The high velocity water introduced tangentially into the drain opening of the toilet tank and the resulting swirling action in the water draining from the tank are illustrated by the arrows in FIG. 4.

The drain stopper seat 26 has a radially extending barbed fitting 54 (FIG. 5) which is connected to one end of a filler conduit in the form of a pliable hose 56 (FIG. 1). The other end of the filler hose 56 is connected to the lower end of the existing filler tube 58 (FIGS. 1 and 2) of the standard ballcock valve 12. The interior of the barbed fitting 54 (FIG. 5) communicates with the upper pressure chamber 40 of the drain stopper seat 26. A plurality of circumferentially spaced orifices 60 (FIGS. 4 and 5) are formed in an interior wall 40*a* of the upper pressure chamber 40. The orifices 60 are very small in relative terms. They communicate between the upper pressure chamber 40 and the upper portion of the central passage 28 that extends through the drain stopper seat 26 and the cylindrical shank 18. Water under relatively high line pressure from the filler hose 56 passes through the upper pressure chamber 40 and into the central passage 28.

When the stopper 30 is in its raised and open position illustrated in FIG. 5, water from the head of water in the tank 10 drains through the central passage 28 into the toilet bowl 16. At the same time, the float 48 descends, immediately turning ON the ballcock valve 12. Relatively high pressure water from the ballcock valve 12 is injected into the water draining from the tank to increase the velocity of the water draining from the tank 10. The orifices 60 are sized and oriented to form a plurality of downwardly and tangentially directed water jets as illustrated by the arrows in FIGS. 4 and 5. As a result water from the tank 10 passes more rapidly into the bowl 16 than if the tank had a conventional drain outlet. The tangentially directed jets help fling the water laterally when it strikes the ledge 61 (FIG. 2) of the conventional bowl 16. This is indicated diagrammatically by the criss-cross phantom lines in FIG. 2. This facilitates more rapid movement of the water through the chambers in the conventional bowl 16. The section of the bowl 16 visible in FIG. 2 is not intended as a precise representation of the actual bowl construction. It is merely used to illustrate the beneficial aspect of the swirling of the water draining from the tank 10 induced by the jets from orifices 60.

Referring to FIG. 5, the stopper 30 has a generally cylindrical hollow construction with a pair of opposed, tapered circumferential shoulders 62 and 64 between which is mounted a readily replaceable elastomeric O-ring 66. A catch or flange 68 extends from the guide rod 32 near the upper half of the stopper 30. One end of a chain 70 (FIG. 2) is connected through a hole in the flange 68. The other end of the chain 70 is conventionally connected to the outer end of a lever arm 72. The inner end of the lever arm is connected to a flush handle 74 conventionally mounted on a pivot through a hole in the upper left region of the front wall 10*a* of the tank 10.

The upper wall 26*b* (FIG. 5) of the upper pressure chamber 40 has a round curvature. It joins with the cylindrical interior wall 40*a* of the drain stopper seat 26. The lower end of the interior wall 40*a* joins an inwardly tapered wall section 26*c* of the drain stopper seat 26. The tapered wall section 26*c* joins the wall 40*a* with the upper end of the cylindrical shank 18. The central passage 28 thus converges in diameter from its upper end to its lower end. This tends to further increase the velocity of the water draining from the tank 10 into the bowl 16.

The outer diameter of the stopper 30 (FIG. 5) is less than the diameter of the central passage 28. When the stopper 30 is in its lower closed position illustrated in FIG. 6, the O-ring 66 seats against the inwardly tapered wall section 26*c* of the drain stopper 26. The overflow apertures 46 in the cylindrical shank 18 are below the O-ring 66 and are unobstructed so that water from the overflow tube 38 can pass into the toilet bowl 16. The orifices 60 in the inner wall 40*a* of the drain stopper seat 26 are above the O-ring 66 and are unobstructed so that water from the filler hose 56 can refill the tank 10.

When the tank 10 is filled with water to a predetermined level L indicated by the wavy line in FIG. 2, the stopper 30 sits in its lowered closed position illustrated in FIG. 6 in which the central passage 28 between the tank 10 and the bowl 16 is sealed. The stopper 30 is hollow and otherwise buoyant. However, the pressure of the head of water above the stopper 30, and the absence of any water pressure on the underside of the stopper 30, maintain the stopper in its lowered closed position inside the drain stopper seat 26. When the flush handle 74 is manually depressed, the lever arm 72 connected thereto pulls upwardly on the chain 70. This lifts the stopper 30 out of the drain stopper seat 26. The buoyancy of the stopper 30 causes it to float upwardly to a predetermined raised position illustrated in FIG. 5. Water from within the tank 10 flows downwardly through the central passage 28 into the toilet bowl 16. As the water from within the tank 10 is draining into the bowl 16, pressurized water from the ballcock filler hose 56 travels through barbed fitting 54 into a the annular upper pressure chamber 40 of the drain stopper seat 26. This pressurized water then exits the chamber 40 downwardly and tangentially through the circumferentially spaced orifices 60 as illustrated by the solid arrows in FIGS. 4 and 5. Water draining from the tank 10 thus joins with tiny relative high pressure water jets from the orifices 60. This significantly increases the rate at which the water drains from the toilet tank thereby increasing flushing efficiency. The stopper 30 generally remains unsealed for less time than a standard flapper valve.

The curved upper wall 26*b* (FIG. 5) of the drain stopper seat 26 forms a streamlined upper inlet of the central passage 28. This curved surface improves the efficiency of the flow from the tank through the central passage 28 and into the toilet bowl 16. Referring to FIG. 1, the curved upper surface 26*b* of the drain stopper seat 26 functions like a hydrodynamically streamlined cowling. This cowling directs water from the tank through the central passage 28 with less turbulence and resistance than encountered by water draining over the sharp edges of a standard flapper valve seat.

When the stopper 30 is lifted out of the drain stopper seat 26, it floats until most all of the water from the tank 10 drains through the central passage 28. The stopper 30, which has been gradually descending, re-seats itself within the drain stopper seat 26 with its O-ring 66 in abutment with the inwardly tapered surface 26*c*. The stopper 30 is actually slammed into its closed position as a result of the jets of water from orifices 60 pushing downwardly on upper shoulder 62. The flat face of shoulder 62 is substantially perpendicular to the direction of the inclined jets of high pressure water.

The O-ring 66 provides a seal between the stopper 30 and the interior wall 40*a* of the drain stopper seat 12. Thereafter, additional water from the ballcock filler hose 56 passes through the barbed fitting 54, through the upper pressure chamber 40, and through the orifices 60 to refill the tank 10. The tank 10 is refilled to the predetermined level L in FIG. 2. The bowl 16 is refilled from the standard refill hose 44 connected to the ballcock valve 12 through the overflow tube 38. The water from the tube 38 passes through the lower refill chamber 42. From there the water passes through the apertures 46 beneath the stopper 30, through the cylindrical shank 18 and into the bowl 16. The float 48 rises until the water reaches the predetermined level L at which time the ballcock valve 12 turns OFF.

The preferred embodiment of my flush valve can be inexpensively manufactured in high volume at relatively low cost. The male threaded shank 18, drain stopper seat 26, stopper 30, overflow tube 38 and stopper guide mechanisms can be made of injection molded plastic parts. The parts may be shaped, assembled and joined with adhesives, sonic welding or spin welding depending upon the type of plastic used and the cost of the mold tooling required. The filler hose 56, seal ring 24 and gasket 29 may be made of suitable materials commonly used in plumbing applications. The nut 22 may be made of metal, plastic or any other suitable material.

My preferred embodiment can be installed in conventional toilets with 3.5, 5 or 7 gallon tanks. The stopper 30 will remain open less time than the pre-existing flapper valve. Therefore less water will be used to flush the bowl, but the flush will efficient and complete. With my new flush valve the water level in the tank can be adjusted downwardly without sacrificing flush efficiency. My preferred embodiment can also be installed in the newer toilets having 1.6 gallon tanks to improve the flushing efficiency thereof.

The inlet to the drain stopper seat 26 is approximately two inches above the level of the conventional drain outlet which is the flapper valve seat. Therefore the last two inches of water in the tank are not drained during a single flush with my new flush valve.

Conventional toilets require periodic replacement of the flapper valve. In a toilet equipped with my new flush valve only the O-ring 66 needs to be replaced after a long period of use. This O-ring is considerably cheaper than a new flapper valve.

While I have described a preferred embodiment of my flush valve for a low water volume toilet, it will be understood by those skilled in the art that my invention can be modified in both arrangement and detail and can be adapted to various toilet configurations. The flush handle can be replaced with other types of manual actuators such as the pushbutton type. An improvement in flush efficiency can even be achieved without directing the water from the ballcock valve filler tube into the central passage. The streamlined shape of the stopper valve seat and the diminishing diameter of the central passage will facilitate drainage velocity increase. Therefore, the protection afforded my invention should only be limited in accordance with the scope of the following claims.

I claim:

1. In a toilet having a bowl, a tank connected to the bowl for holding a quantity of water for draining into the bowl through a drain outlet in a bottom wall of the tank, a ballcock valve mounted in the tank and connected to a pressurized water line, a float connected to the ballcock valve for turning the ballcock valve ON and OFF in response to a water level in the tank, and a manually operated flush actuator mounted on the tank, the ballcock valve further having a filler tube for filling the tank with water from the water line and a refill hose for refilling the bowl with water from the water line, the improvement comprising:

a drain stopper seat mounted over the drain outlet and having a generally cylindrical central passage through which water from the tank can drain into the bowl, the stopper seat including a pressure chamber, a plurality of downwardly directed circumferentially spaced orifices in an interior wall of the stopper seat communicating with the pressure chamber and with the central passage, and a fitting communicating with the pressure chamber;

a filler hose coupled between the filler tube and the fitting of the drain stopper seat;

a stopper sized for sealing the central passage through the drain stopper seat when in a lowered position so that water ejected from the orifices will fill the tank and for opening the central passage when in a raised position so that water ejected from the orifices will join water draining from the tank through the central passage;

means for mounting the stopper for vertical reciprocation between the lowered position and the raised position;

means for connecting the flush actuator to the stopper so that manual operation of the actuator will cause the stopper to move upwardly from the lowered position to a raised position; and an overflow tube having a lower end coupled to the drain outlet of the tank and an upper end for receiving a remote end of the refill hose of the ballcock valve.

2. The invention of claim 1 and further comprising a cylindrical shank connected to a lower end of the drain stopper seat and extending through the drain outlet of the tank, the shank having a central passage communicating with the central passage of the drain stopper seat, the lower end of the overflow tube being connected to the drain stopper seat so that water can flow from the overflow tube, through at least one aperture formed in a wall of the drain stopper seat and into the bowl when the stopper is its lowered position.

3. The invention of claim 2 wherein the drain stopper seat has a refill chamber for communicating between the lower end of the overflow tube and the at least one aperture in the wall of the drain stopper seat.

4. The invention of claim 1 wherein the drain stopper seat has a rounded top edge for streamlining an outer configuration thereof to decrease the flow resistance into the central passage.

5. The invention of claim 1 wherein the stopper is buoyant.

6. The invention of claim 2 wherein the central passage through the drain stopper seat has a first diameter and the central passage through the cylindrical shank has a second diameter wherein the first diameter is larger than the second diameter.

7. The invention of claim 1 wherein the stopper has an O-ring that seals the central passage through the drain stopper seat.

8. The invention of claim 1 wherein the lower end of the overflow tube is screwed into a threaded bore formed in the drain stopper seat.

9. The invention of claim 2 wherein the drain stopper seat includes a disk-shaped base and an elastomeric gasket surrounds the cylindrical shank and is positioned between the disk-shaped base and the bottom wall of the tank.

10. The invention of claim 9 wherein the cylindrical shank has male threads and a nut is screwed over the shank against a lower side of the bottom wall of the tank to squeeze the gasket between the disk-shaped base of the drain stopper seat and an upper side of the bottom wall of the tank.

* * * * *